US005303446A

United States Patent [19]

Maresh

[11] Patent Number: 5,303,446

[45] Date of Patent: Apr. 19, 1994

[54] MANUALLY ENGAGEABLE PAINT ROLLER

[76] Inventor: Joseph D. Maresh, 19919 White Cloud Cir., West Linn, Oreg. 97068

[21] Appl. No.: 936,626

[22] Filed: Aug. 28, 1992

[51] Int. Cl.[5] ..... B05C 1/08

[52] U.S. Cl. ..... 15/230.11; 492/19

[58] Field of Search ..... 15/27, 230.11, 98; 74/98; 492/13, 15, 18, 19

[56] References Cited

U.S. PATENT DOCUMENTS

| | | | |
|---|---|---|---|
| 397,521 | 2/1889 | Rourke | 15/98 |
| 1,641,984 | 9/1927 | Miller | 15/98 |
| 2,187,585 | 1/1940 | Grigas | 15/50.3 |
| 2,913,752 | 11/1959 | Boyles | 15/230.11 |
| 2,929,089 | 3/1960 | Nall | 15/230.11 |
| 3,724,016 | 4/1973 | Soffer | 15/98 |
| 4,107,815 | 8/1978 | Dumesnil, Jr. | 15/257.05 |
| 4,196,491 | 4/1980 | Baril | 15/230.11 |
| 4,575,890 | 3/1986 | Hidle | 15/230.11 |
| 4,630,952 | 12/1986 | Elbaum | 15/27 |
| 4,728,213 | 3/1988 | Geberth, Jr. | 401/197 |
| 4,875,246 | 10/1989 | MacGregor | 15/98 |
| 4,941,229 | 7/1990 | La Pierre | 15/257.06 |
| 5,095,575 | 3/1992 | Jarecki | 15/230.11 |

FOREIGN PATENT DOCUMENTS

| | | | |
|---|---|---|---|
| 466225 | 5/1914 | France | 15/27 |
| 13556 | 8/1916 | United Kingdom . | |

*Primary Examiner*—Philip R. Coe
*Assistant Examiner*—Terrence R. Till

[57] ABSTRACT

A roller style paint applicator incorporating a mechanism which will cause an axial rotational force to be exerted to the paint roller in order to facilitate the distribution of paint to the roller during paint saturation. The mechanism also will allow the paint roller to free wheel during the painting act. The mechanism consists of a pinion gear or cylindrical frictional surface affixed to one of the roller hubs which will become engaged with a gear or arcuate frictional surface during paint pool to roller saturation. During painting, disengagement of the gear or arcuate frictional surface from the pinion enables the paint roller to roll unimpeded.

17 Claims, 9 Drawing Sheets

MANUALLY ENGAGEABLE PAINT ROLLER

BACKGROUND—FIELD OF THE INVENTION

This invention relates to paint applicators, and more particularly, to a roller type paint applicator which has a mechanism to cause the roller to rotate while the paint roller is being saturated with paint.

BACKGROUND—DESCRIPTION OF PRIOR ART

Some manufactures have recognized that saturation of a roller with paint can be a timely process, and have designed paint rollers which transfer this paint to the roller via a tube or hose which may be pressurized with paint to cause paint to flow to the inner wall of the roller cylinder. The paint will then flow to the roller external surface via a porous medium such that the roller may be resturated. These systems are significantly more complicated, expensive, heavy, and are not appropriate for small scale use because of the required cleaning and flushing necessary to return the apparatus in a storable condition. Also, the specialized rollers required are expensive, especially considering that they are disposable. An example of a device of this nature may be found by referring to Geberth, U.S. Pat. No. 4,728,213.

One patent which identified the technique of paint roller saturation as a process to be improved upon consists of a motor driven mesh cylinder partially immersed in a tray paint pool. The intention in the utilization of this device is to place the absorbent surface of a standard paint roller in contact with the rotating mesh cylinder in order for paint transfer to occur. This patent, entitled 'Portable, Motor-driven Paint Roller Loader', La Pierre, U.S. Pat. No. 4,941,229; is however inconsequential to the invention at hand. Continuing with other prior art which may be of interest, but is inconsequential to a greater degree is U.S. Pat. No. 4,107,815 Dumesnil, a 'Tray Having Paint Transfer Roller for Pad painters'; U.S. Pat. No. 4,196,491 Baril, a 'Controlable Paint Roller' which incorporates a braking mechanism within the paint roller; and U.S. Pat. No. 2,913,752 Boyles, 'Paint Roll and Paint Roll Mounting' which allows the paint roller to be driven with a motor when it is desired to clean or remove paint from the roller.

SUMMARY OF THE INVENTION

Methods of applying paint upon surfaces generally may be categorized as brushing, spraying, padding, or rolling. This invention pertains to the method of rolling, and to improve and expedite the process by incorporating an improvement upon a tool known commonly as a paint roller.

Paint rollers have been on the market for decades. Many of the current rollers on the market remain essentially unchanged from the early designs. The success of the early designs is due to the simplicity of the design requirements. A rolling paint applicator only requires a handle fixed to an applicator axle, to which a cylindrical absorption material with hub axle bearings need be installed.

Recently, in the course of the last few years, the designs of paint rollers which incorporate an additional feature known as a splatter shield became prevalent. A splatter shield screens the operator from the paint globules spun off of the roller while the roller is in rolling contact with the surface to which paint is being applied. The splatter shield also prevents the paint fly-off from depositing upon the floor or other surrounding surfaces, therefore eliminating the necessity that tarps or drop cloths be spread about the painting vicinity. It may be said that, in this respect, the incorporation of splatter shields over paint rollers was an improvement.

Difficulties in transferring paint from the tray paint pool to the roller have always existed, and the object of this invention was to facilitate the paint roller saturation procedure. These difficulties may be attributed to the fact that it is difficult to impart rotational motion to the roller while the roller is in contact with the paint pool, and/or the paint tray ramp. Typically, in order to distribute the paint from the paint pool to the roller, one must 'dap' and roll paint onto the absorbent surface of the roller, followed by moving the roller to the tray ramp region in order to further distribute the paint and allow excess to drain back to the paint pool. The primary difficulty thus encountered in this procedure is imparting rotational force to the roller. When one is 'dabbing' the paint onto the roller in the paint pool, the standing pool of paint is capable of imparting only negligible torque to the roller to cause the roller to rotate. If the resisting torque due to the frictional forces present at the roller hub bearings is greater than the torque generated due to the shear forces developed at the interface between the roller absorbent material and the pool surface, the roller will not rotate. This phenomenon is compounded because the portion of the 'dry' roller which has contacted the paint pool becomes the 'wet', heavy side of the roller, and thus due to gravity, is influenced to remain at the 'as dabbed' lower orientation. Therefore, a technique is required to coordinate the angular momentum of the roller against the available shear force, in order to cause the paint roller to rotate and distribute the paint. An increase in the paint viscosity expedites this procedure.

Continuing the procedure, when the excess paint thus distributed is rolled or wiped off of the roller onto the paint tray ramp surface, the friction coefficient between the saturated roller and the ramp often is insufficient to cause the roller to rotate readily. Again, a technique becomes necessary to accomplish this. At both occurrences of difficulties, the problem becomes accentuated if visual feedback is blocked with a splatter shield. This invention solves this problem by providing a mechanism which will independently allow a rotational force to be applied to the roller.

In the first embodiment, a nonstandard driving disk of the profile, which in one portion resembles a spiral, is utilized. This drive disk will engage and drive a pinion affixed to rotate with the paint roller rotational axis, to thereby cause paint roller rotation. If gear teeth are employed on the drive disk and driven pinion, the arc at which the pitch is defined variably increases in the portion where engagement occurs. Essentially, while the pinion is being driven, the constant pitch radius teeth of the driving gear properly mesh on the driven pinion gear pitch circle; however, prior to complete and proper engagement, the pitch radius of the driving gear is gradually increased to meet the pitch circle of the pinion. This variable ptich radius of the driving gear may be a linear, or even a logarithmic curve function. The intent of the pitch radius geometry is to have the teeth gradually introduced or swept into the pinion teeth in a tangential direction, prior to the desired rotation of the paint roller.

The consequence of having a variable pitch radius, as described, implies that the driving gear has a large proportion of teeth located at a pitch radius reduced to such a degree as to avoid tooth contact. Therefore, the gear teeth in these regions actually need not be present. This gear would thus become what may be referred to as a specialized segment gear.

The ratio of diameters between the pinion gear and this specialized segment gear is perhaps best established at approximately four to one. Establishing this ratio, and allowing gear teeth to remain on approximately ninety degrees of the segment gear circumference, results in a ninety degree swing of the segment gear required to cause the pinion gear, and hence the paint roller, to rotate one revolution. The segment gear may be further modified and lightened by removing additional material radially inward at the regions which had the teeth removed. Furthermore, in order to provide a control handle on the segment gear, a narrow band of material diametrically opposite the toothed segment may be allowed to remain. The width of this handle need only be of adequate dimensions as to facilitate easy manipulation and control with the operator's hands and fingers. The resulting shape of the segment gear will thus resemble in some respects a pie section, where the arc portion of said section contains the gear teeth, and the point portion of the said pie section would represent the handle or actuator. The segment gear may have a shaft or axle molded integrally on the side of this segment gear, at its pivot point, between the teeth and the handle, in order to pass through and pivot about the proximate side of a paint roller splatter shield to which the segment gear may be juxtaposed. When incorporating this invention upon paint rollers without a splatter shield, the paint roller handle may be advantageously utilized as the segment gear axle, in the region where the paint roller handle extends outward from the roller hub, and circuitously extends toward the handle grip.

Regarding the operation of this device, it has been stated that during the painting act, the segment gear is not engaged with the pinion gear. This allows complete free wheeling of the paint roller to occur. When it is desired to saturate the paint roller with paint, one only needs to position the roller slightly into the paint pool surface, and swing the segment gear approximately ninety degrees. This will cause the roller to rotate one revolution while absorbing the paint. At this point, if desired, the operator may position the paint roller to contact the paint tray ramp, and swing the segment gear back ninety degrees to the segment gear original position, thereby cuasing the paint roller to rotate against the paint tray ramp, backwards one full revolution, to the original roller position. The rotational direction of the roller against the ramp should preferably be established, by design, such that as the roller rotates against the ramp, the excess paint which is wiped off tends to accumulate and drain away on the downward side of the ramp to roller contact region. For example, if the ramp slopes down away from the operator, then the roller should rotate when in contact with the ramp, such that the lower region of the roller rotates toward the operator.

Several additional features of this specialized segment gear are desirable to further facilitate operational characteristics. One of these features would, for example, incorporate a radial protrusion at one end of the arcuate toothed segment which serves to limit the segment gear rotation during the paint roller saturation motion. Alternate means to accomplish this would be to provide a protruding tab stop on the segment gear handle which will contact a portion of the splatter shield, or to provide a stop on the segment gear axle. The purpose of providing this feature would be to avoid unnecessary disengagement of the segment gear to the pinion gear, at the end of the full saturation stroke. Also, regarding the operation of this invention, a very significant convenience attribute would be to connect a wire or cord to the segment gear handle in order to actuate the segment gear when it is desirable to utilize a long extension pole with the paint roller assembly. Alternatively, it is possible to design this device such that the segment gear (and therefore the roller) is actuated by a finger trigger control.

Continuing with the operational characteristics, it may be desirable to incorporate a torsion spring to the segment gear axle to constantly bias the paint roller to the free wheeling mode. When a torsion spring is utilized for this function, it is necessary to provide an additional segment gear stop in order to establish a segment gear park position during the paint roller free-wheeling mode. It may, alternatively, be is possible to eliminate the torsion return spring, and torsion return stop by simply relying on friction between the segment gear axle and the segment gear journal to frictionally maintain the segment gear at the park position. This is the choice of the embodiments illustrated.

Directing attention now to the mechanics of the gears employed in this invention, we find considerations which normally are not necessary in gear design, due to the intended gear engagement condition. In the embodiments to be illustrated, the axis center line spacing between the segment gear and the pinion gear is fixed. The segment gear is to be rotated into engagement with the pinion gear, and with standard spur gear profiles, such as involute, this is considered unacceptable. The difficulty with this action is due to the fact that the pinion gear must be allowed to be randomly oriented prior to segment gear engagement. This will often result in unsynchronized engagment; and when this occurs, engagement is not possible. If one assumes that compliance of the segment or pinion gear axle housing is present, engagement would only be possible by subjecting the segment gear to additional rotational engagement force. Therefore, in order to achieve the smoothest gear engagement possible, a modification of tooth design is in order. The selection of empcycloidal gear teeth designs would thus be warranted.

Directing attention now to the second embodiment, the design of a gear system is shown which allows satisfactory engagement with a segment drive gear of constant pitch radius. Again, an empcycloidal gear design of the drive gear is utilized, although selection of a lantern pinion gear is utilized at the paint roller hub. This gear combination will allow unimpaired engagment of constant radius segment gears with random pinion orientations, if appropriate geometrical relationships are carefully followed. Although the substitution of this gear design limits the load and speed capabilities, these considerations may be considered irrelevant for this application. Again, the selection of the ratio of pitch diameters is established at approximately four to one, in order to minimize the rotational actuation of the drive gear which would yield one revolution of the pinion gear. A closer gear ratio may be preferred under certain conditions, if a reduction of the actuation force at the drive gear is desired. Similar features may be incorporated on this embodiment, as with the first embodiment, such as drive gear rotational stops, a spring return, and a drive handle actuator cord.

In discussing this invention, reference has been limited to roller applicators which have an axis substantially longer than the diameter at which the absorbent material is located. This discussion is therefore extended to include rollers which have a substantially reduced axis length in proportion to its diameter. The proportions thus described would define a paint roller which substantially represents a ring, or a paint roller of annular configuration. Such rollers are available on the market today in cylindrical form for painting narrow areas, and as a pair of opposed truncated cones for painting interior corners.

When using rollers of these proportions, a significant advantage when incorporating this invention upon them is that a paint tray is not needed, and the roller may simply be saturated with paint directly from the paint can.

Continuing in general now with all embodiments; the use of toothed or pinned transmission of force between the segment to the pinion is not to be considered inclusive. Another means to accomplish this may utilize the application of frictional surfaces which are designed to achieve the same objective. The principal of operation remains identical, although an increase in axial force would be required to develop adequate frictional force to cause paint roller rotation.

These and other advantages or objects of the invention will become apparent upon consideration of the following detailed description along with the attached drawings, in which.

DESCRIPTION OF THE PREFERRED EMBODIMENT(s)

Figure 1:
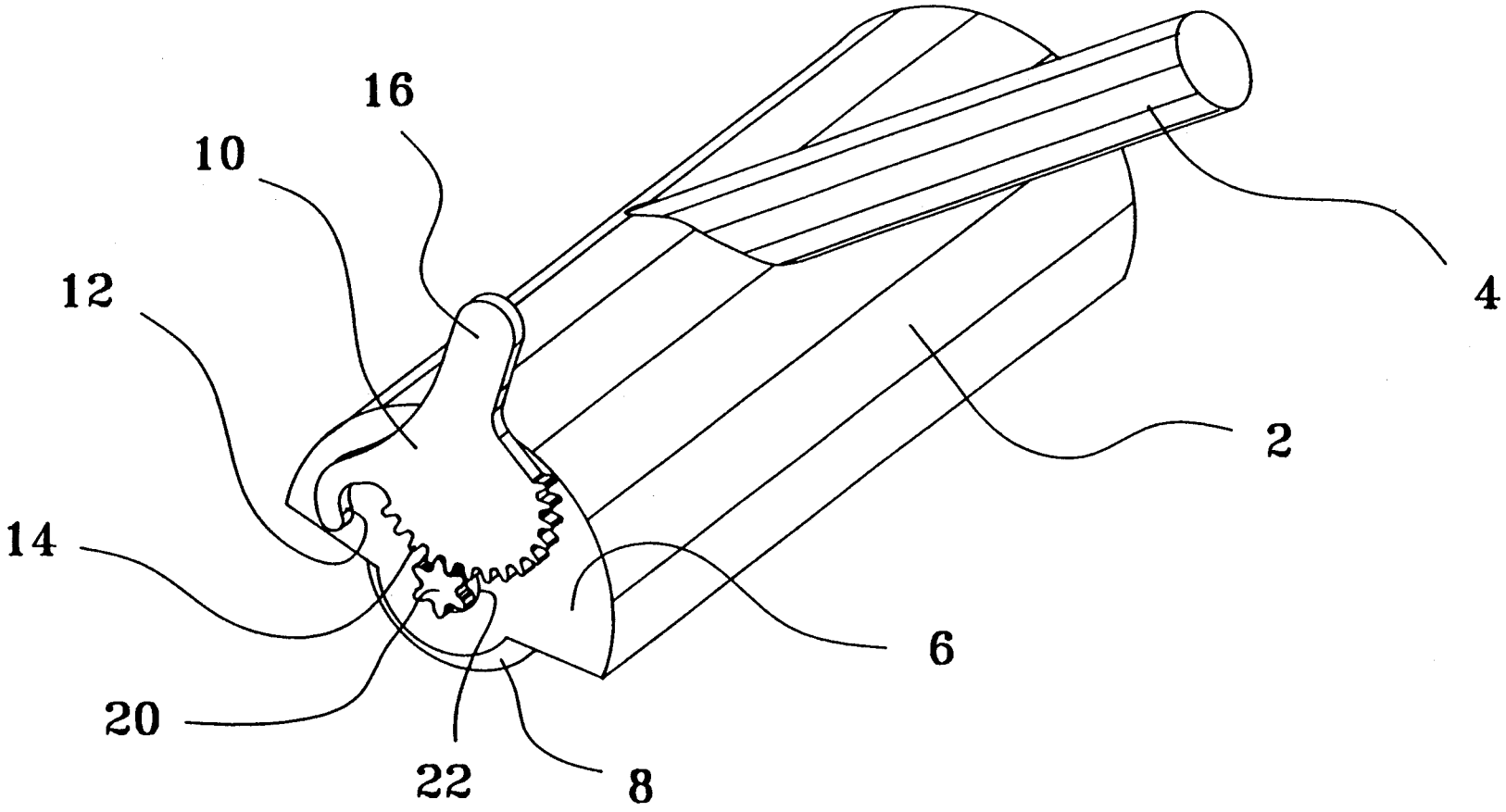
FIG. 1 is an assembled perspective view of the first embodiment.

Continuing now, and describing the figures, FIG. 1 illustrates an assembled view of the first embodiment where paint roller handle 4 is shown to be integrally attached to splatter shield 2. Splatter shield side 6, located at the left side of the paint roller assembly, is the side chosen to incorporate the invention. This is considered the preferred side because right handed people will normally prefer to grasp the paint roller handle with their right hand. Paint roller 8 is shown to be exposed at the underside of splatter shield 2. Paint roller pinion gear 20 will protrude axially outward a sufficient distance to allow variable arc segment gear 10 to be properly engaged. Paint roller hub bearing 22 extends through, and is flush with the outer surface of splatter shield side 6. Variable arc segment gear 10 has stop hook 12 incorporated at one end of the segment gear pitch radius which will contact pinion gear 20 when the segment gear has been actuated to its maximum rotational range. This will prevent the variable arc segment gear teeth 14 from disengaging from the pinion gear teeth at this point of operation. Variable arc segment gear control handle 16 is shown to protrude a sufficient distance above splatter shield 2 as to facilitate operator manipulation.

Figure 2:
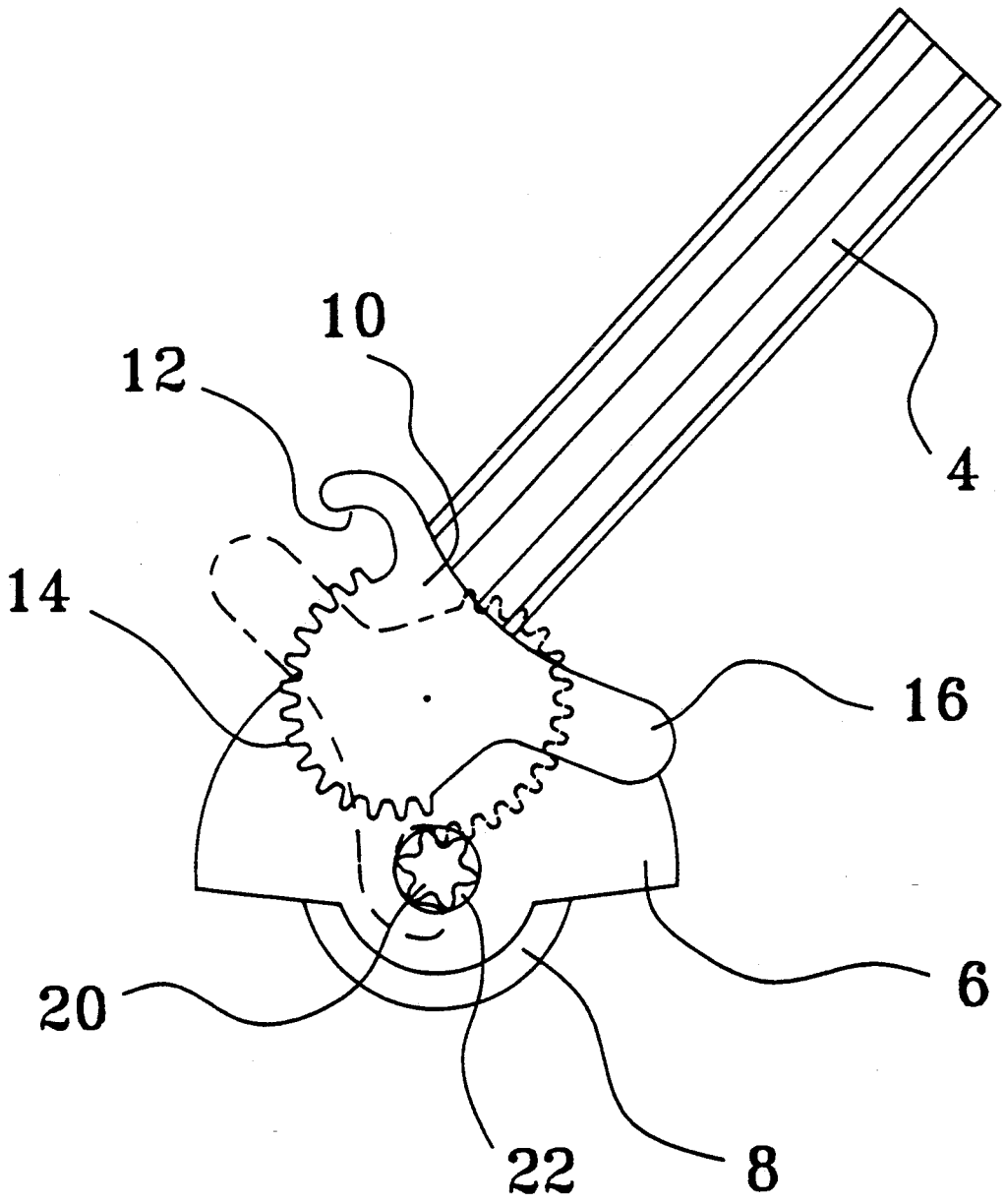
FIG. 2 is an assembled side view of the first embodiment.

Referring now to FIG. 2, a side view is shown which illustrates the variable arc segment gear 10 in two positions. The solid lines of this gear represent the normal free wheeling position of the pinion gear 20, while the dashed lines represent the fully actuated, pinion driven position. It may be seen that in this fully actuated position, the variable arc segment gear stop hook 12 is in contact with the pinion gear 20. Also, by careful study, the variable pitch radius of segment gear teeth 14 is illustrated in the region where engagement to the pinion gear 20 is to occur. Continuing with FIG. 2, paint roller hub bearing 22 is shown to be tangent with the tip of the pinion gear teeth. This is desirable in order to maximize the pinion gear diameter and reduce functional problems. It may be noted that it is not practical to design a hub bearing 22 of a diameter smaller than the diameter defined at the tip of the pinion gear 20, because such a design would complicate assembly of the invention. Referring to the remaining components in FIG. 2, we have paint roller handle 4, variable arc segment gear control handle 16, splatter shield side 6, and paint roller 8.

Figure 3:
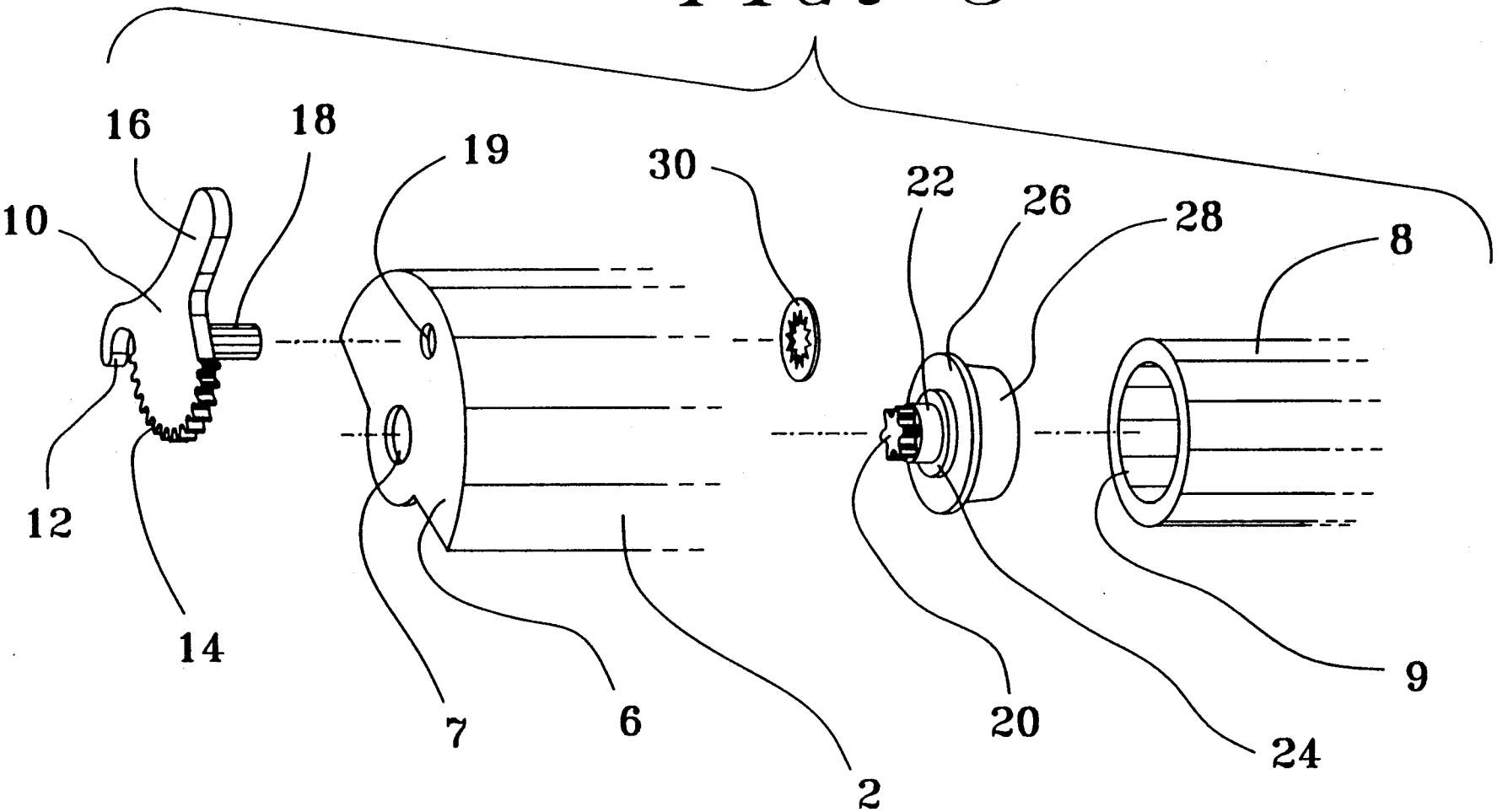
FIG. 3 is a fragmentary exploded view of the first embodiment.

Directing attention now to FIG. 3, a fragmentary exploded view is illustrated which shows the manner in which this embodiment is assembled. Starting with the variable arc segment gear 10, segment gear axle 18 is shown to protrude toward splatter shield side 6 through axle journal 19. In order to secure segment gear axle 18 to splatter shield side 6, axle retaining clip 30 shall be pushed onto axle and juxtaposed to inner wall of splatter shield side 6. The engaging portions of the variable arc segment gear teeth 14 will properly contact the pinion gear 20 teeth, after the unit has been assembled. Referring to the roller hub component, a taper is present at roller support 28 in order to provide an interference fit with roller core sleeve 9. This interference fit is to ensure that the paint roller 8 will rotate whenever the pinion gear 20 is driven. Hub bearing 22 will be supported by pinion journal 7 at splatter shield side 6 with minimal friction. Hub flange 26 prevents the hub component from being inserted upon core sleeve 9 beyond the proper position. Bearing surface 24 is intended to minimize friction in the lateral or axial direction during all phases of operation.

Figure 4:
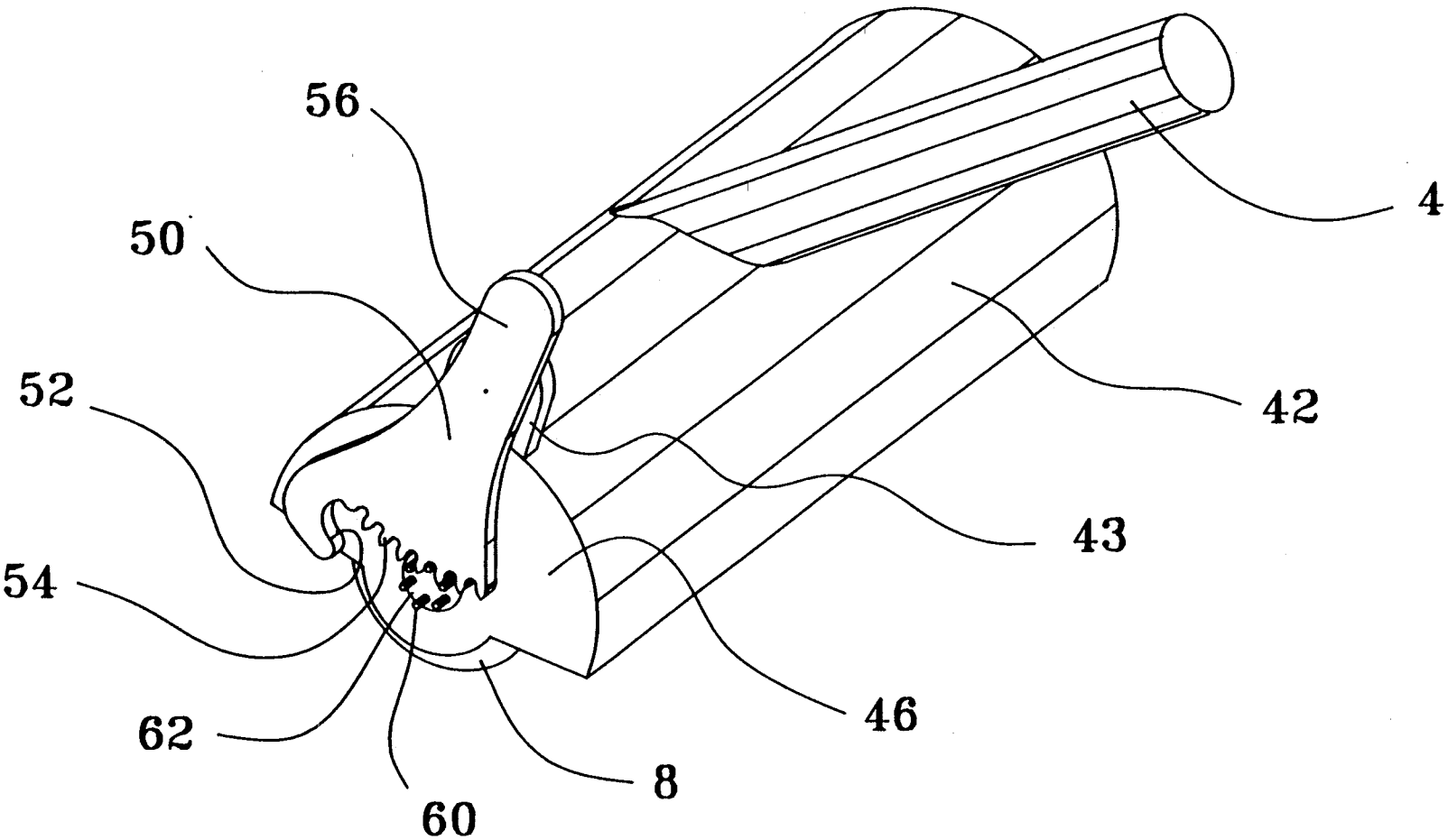
FIG. 4 is an assembled perspective view of the second embodiment.

Continuing now with the second embodiment as illustrated with an assembled perspective view in FIG. 4, splatter shield 42 is shown to be similar to that of the first embodiment. This embodiment operates in an analogous manner as that of the first embodiment. What had been referred to as a segment gear in the first embodiment, will now, for the sake of distinction, be referred to as a sector gear in the second embodiment. This sector gear 50 has sector gear teeth 54 located inclusively on one constant pitch radius. The sector gear hook 52 functions as a sector gear stop in much the same way as the segment gear hook stop of the first embodiment. A sector gear control handle 56 protrudes well above all splatter shield features, with the exception of course, of the splatter shield handle 4. The lantern pinion gear is composed of lantern pin(s) 60 extending axially outward, and spaced parallel uniformly about the lantern gear side 62. The paint roller 8 projects below the splatter shield side 46. Sector gear axle support tab 43 is molded integrally with splatter shield 42.

Figure 5:
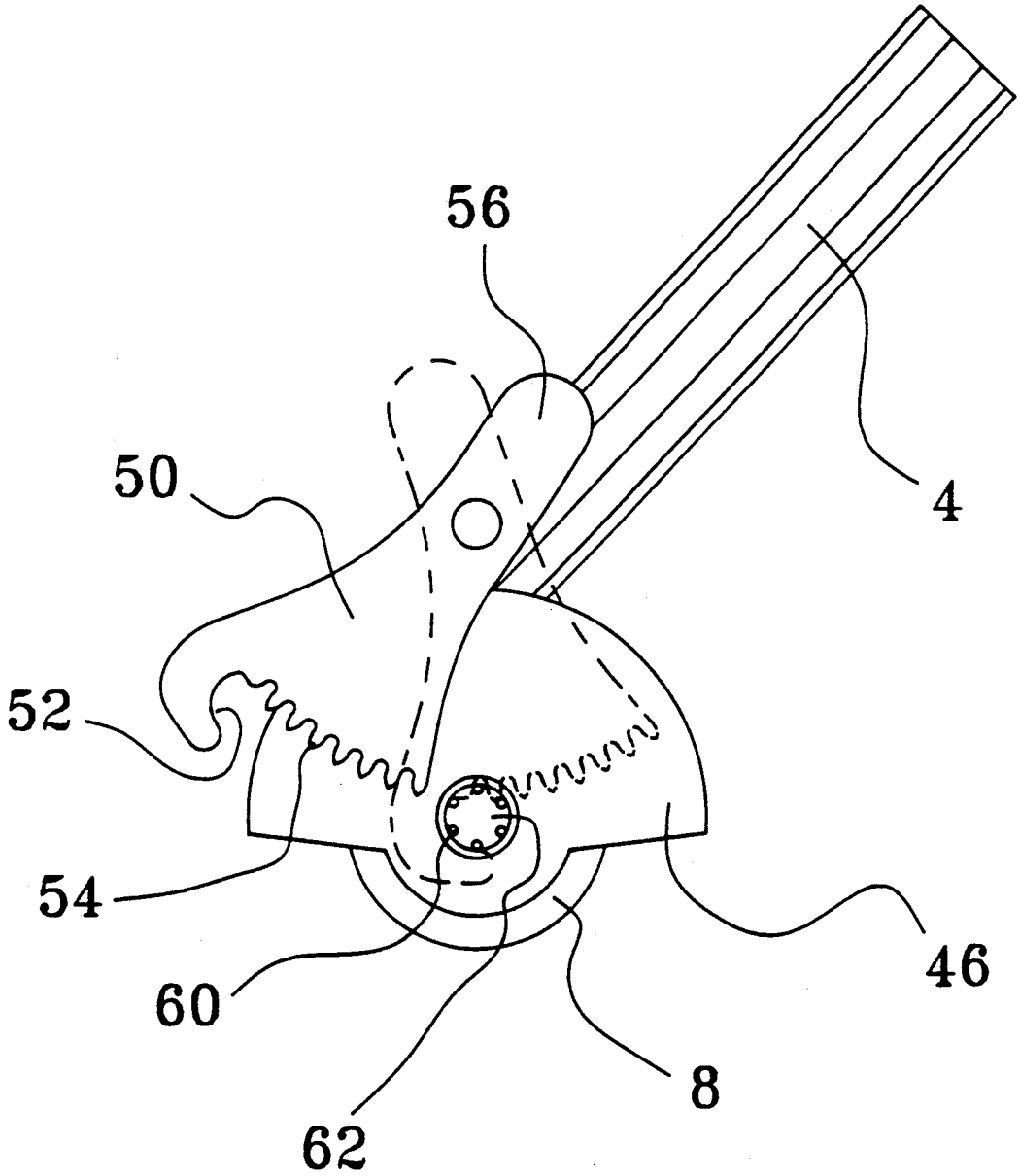
FIG. 5 is an assembled side view of the second embodiment.

Referring now to FIG. 5, a side view is shown of the second embodiment. The sector gear 50 is illustrated with solid lines indicating the normal paint roller free wheeling mode, and with dashed lines indicating the fully actuated paint roller engaged position. Sector gear stop hook 52 is shown to be in contact with lantern pinion gear pin(s) 60 in this fully actuated position. All of the sector gear teeth 54 engage with the lantern pin(s) 60 in a direct tangential manner. Lantern gear side 62 is installed flush with the splatter shield outer side 46. A portion of paint roller 8 extends beneath the splatter shield side 46. Splatter shield handle 4 and sector gear control handle 56 complete the description of the figure.

Figure 6:
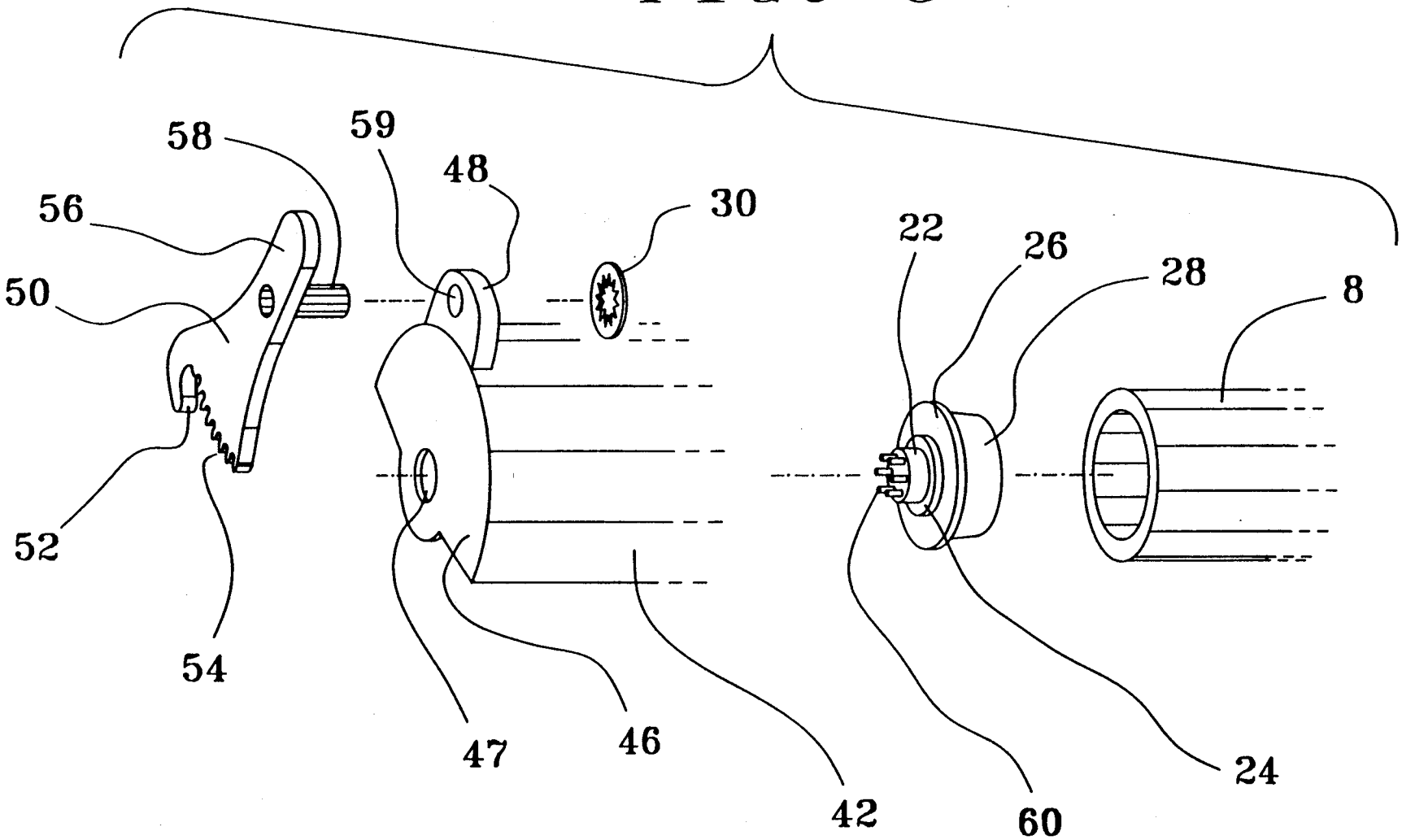
FIG. 6 is a fragmentary exploded view of the second embodiment.

Continuing now with FIG. 6, a fragmentary exploded view is shown of this second embodiment. Sector gear 50 has a sector gear axle 58 molded integrally at the inner side there on. This sector gear axle 58 will be installed to pass through the splatter shield tab 48 at sector gear journal 59 and secured with axle retaining clip 30. Sector gear stop hook 52 and sector gear control handle 56 functions similarly as that of the first embodiment. Splatter shield 42 is similar to the splatter shield of the first embodiment except for the splatter shield tab 48. Fragmentary view of splatter shield 42 with splatter shield side 46 will receive and support hub bearing surface 22 at splatter shield journal 47, and be restrained from axial movement by contact with hub side bearing surface 24 which is juxtaposed to the inner wall of splatter shield side 46. As with the first embodiment, tapered bearing surface 28 and hub flange 26 receive and support paint roller 8 at sleeve 9. The hub is provided with hub pin(s) 60 which mesh with sector gear teeth 54. These hub pin(s) 60 may be of metallic material pressed into the paint roller hub at hub side 62.

Figure 7:
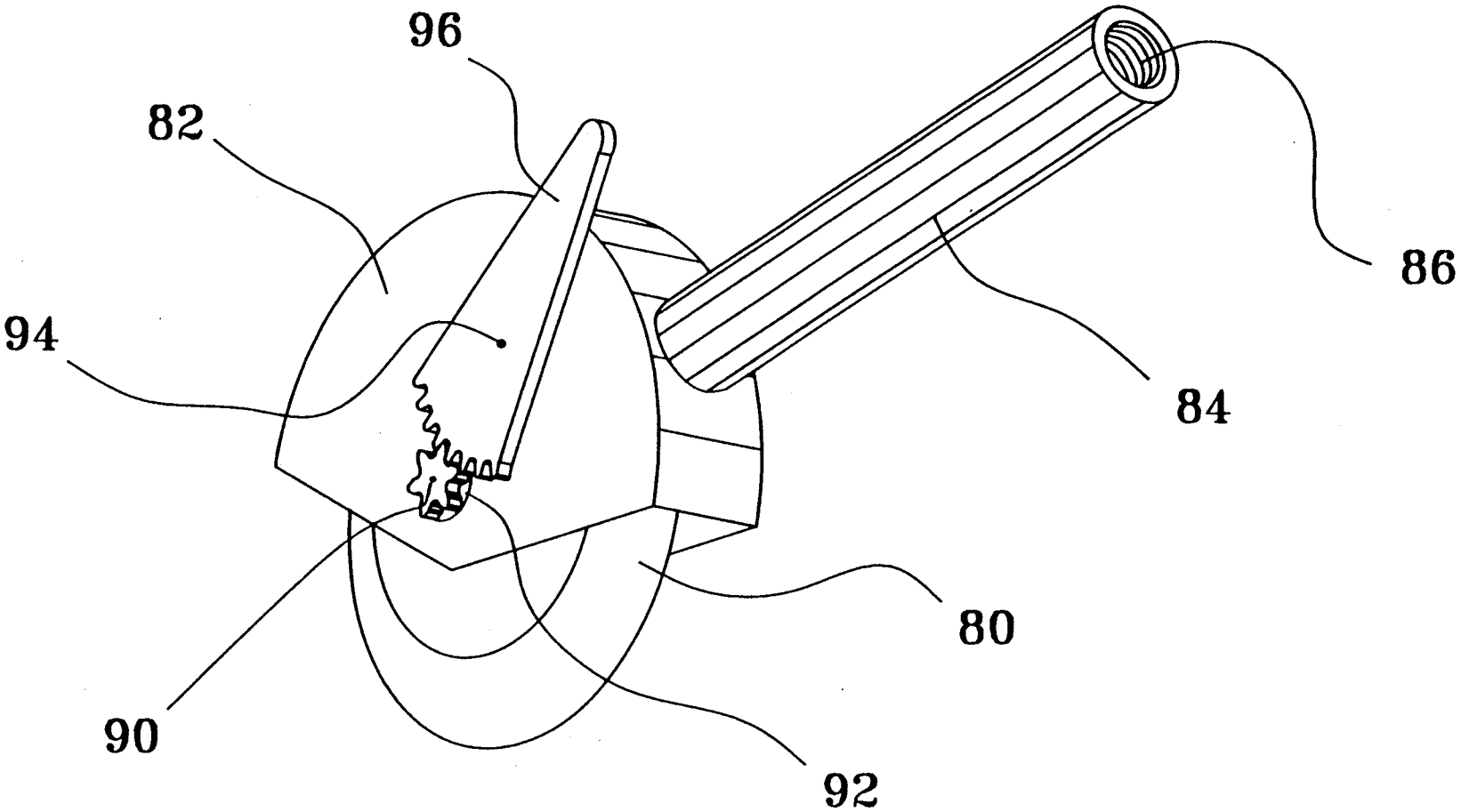
FIG. 7 is an assembled perspective view of a variation of the second embodiment.

Referring now to FIG. 7, a perspective view is illustrated of a style of paint roller used for applying paint to the interior corners of walls. It is apparent from the figure that roller diameter is substantially greater than the roller axis length. This figure essentially is a variation of the second embodiment where sector gear 96 pivots about pivot point 94. Pinion gear 90 protrudes outward a sufficient distance beyond splatter shield side 82 to allow proper tooth engagement with sector gear. Splatter shield handle 84 is illustrated with female threads 86 to enable an unillustrated extension pole to be used. The paint absorbing roller member 80 tapers to a point at its outermost circumference, and is most commonly constructed of foam rubber.

Figure 8:
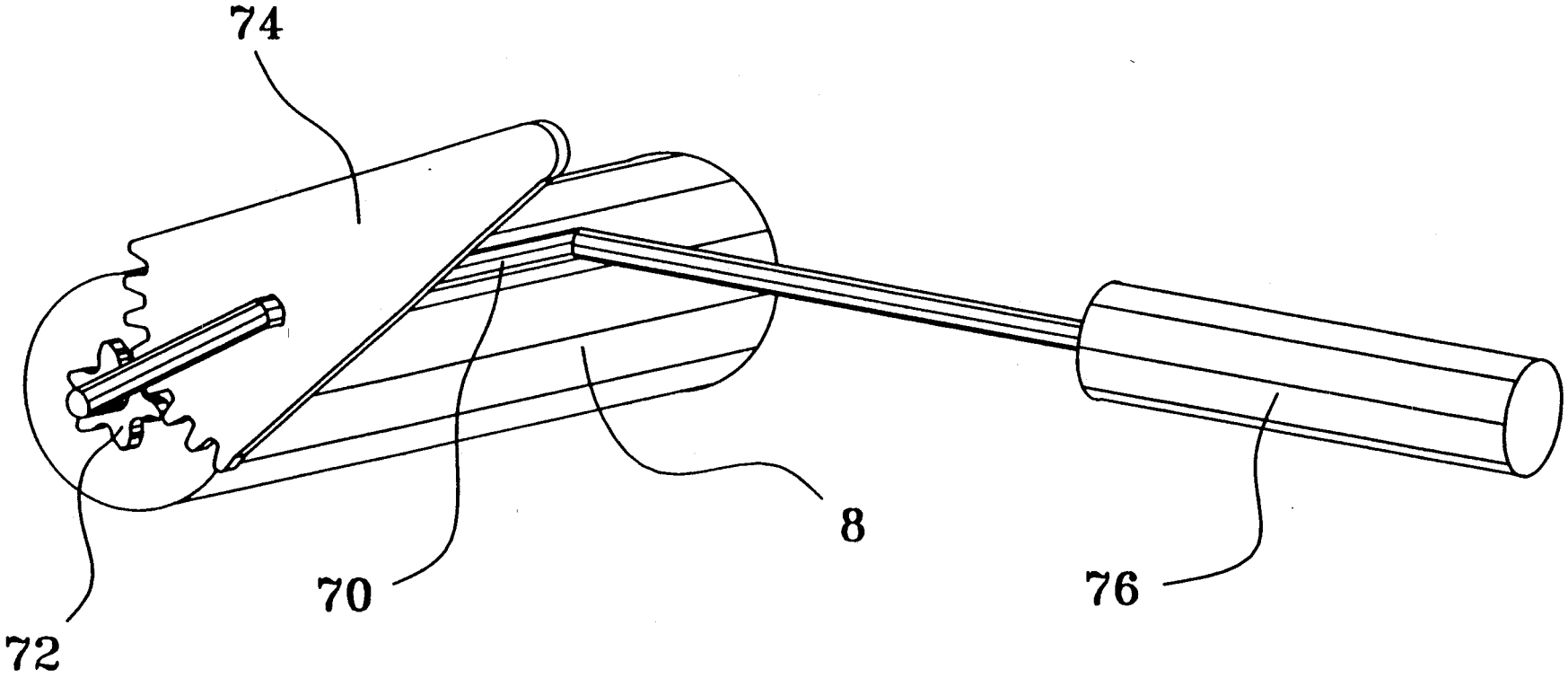
FIG. 8 is an assembled perspective view of the third embodiment.

Referring to FIG. 8, a perspective view is shown of the third embodiment. The principal of operation remain the same as the first two embodiments. The primary distinction with this embodiment is that it has been incorporated upon a paint roller assembly which does not have a splatter shield. Paint roller 8 is nonrotably secured to roller pinion 72 on center with the roller axis. Segment gear 74 is allowed to pivot or rotate about the portion of paint roller handle support 70 which extends parallel to the roller axis. Paint roller handle 76 is secured to distal end of paint roller handle support.

Figure 9:
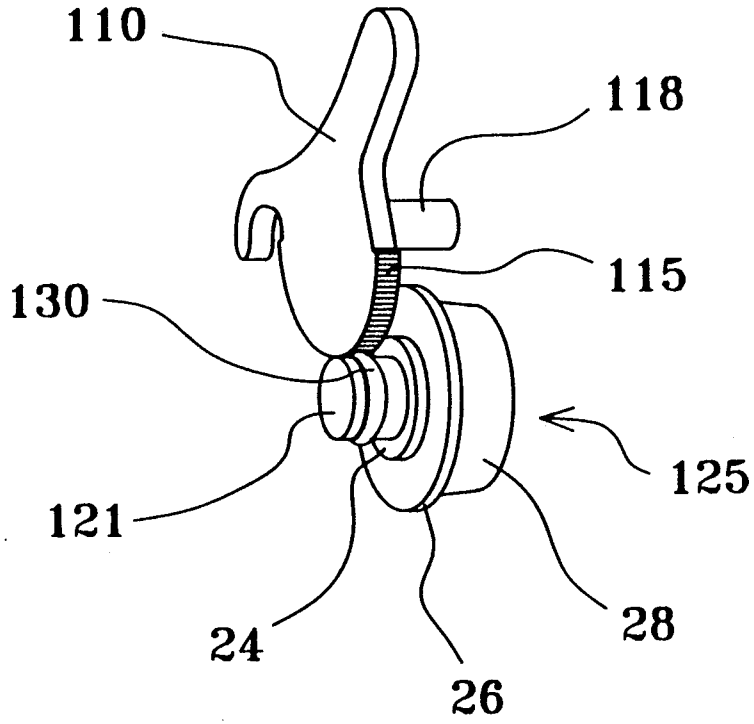
FIG. 9 is a partial assembled view of the first embodiment which alternatively utilizes frictional propelling means.

Directing attention now to FIG. 9, a partial assembled view is illustrated of the first embodiment which alternatively uses frictional force as a propelling means. Variable arc segment disk 110 is shown with knurled arc surface 115 which will engage with pinion drum 121. Pinion drum 121 is illustrated with an elastic ring 130 to aid in the frictional transfer of force between the knurled surface of the engageable disk and the pinion drum. Variable arc segment disk axle 118 may be rotatably secured at the paint roller side by any of the means illustrated and discussed earlier in this text. Paint roller hub 125 is shown with tapered roller support 28 and hub flange 26. Bearing surface 24 will provide lateral hub support when juxtaposed to the inner side wall of the splatter shield illustrated in FIG. 3.

Figure 10:
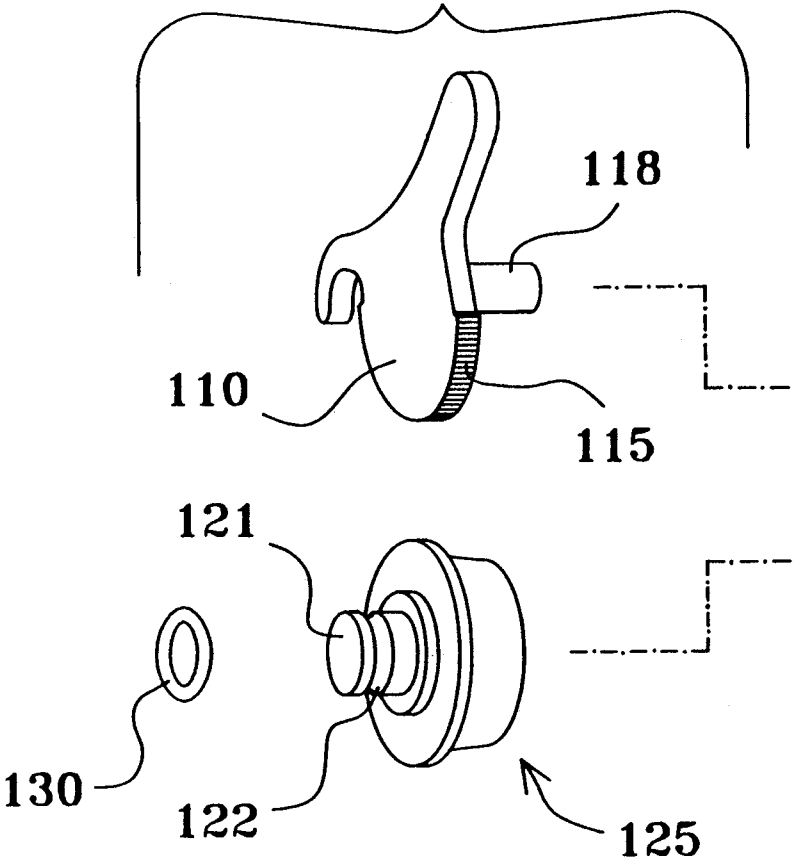
FIG. 10 is a partial exploded view of the first embodiment which alternatively utilizes frictional propelling means.

Referring finally to FIG. 10, a partial exploded view is shown of the elements of FIG. 9, where variable arc segment disk 110, variable arc segment disk axle 118, and knurled arc surface 115 is illustrated in the upper portion of the figure. The lower portion of FIG. 10 illustrates the paint roller hub 125 with pinion drum 121. Circumferential groove 122 established at the pinion drum 121 provides circumferential support for elastic ring 130. Elastic ring 130 may be formed from rubber or any synthetic material in order to improve the friction coefficient between the knurled surface of the engageable disk and the pinion drum. The simplest form for the elastic ring 130 to take may resemble what is known commonly as an "O-ring".

Thus, an improved paint roller has been shown which facilitates the painting act. The invention is applicable to the design and manufacture of new paint rollers and to previously designed or existing paint rollers.

While the preferred embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. An improved paint roller of the type in which a rotatable paint applicator is fixed to a hub which is rotatably secured to a support, wherein the improvement comprises:

(a) a pinion fixed on center to the axial end of said hub;

(b) a drive disk attached to said support such that drive disk is rotated while a portion of said drive disk's circumference is in contact with and causes rotation of said pinion member;

(c) said drive disk having a position which allows said pinion to rotate independently while said drive disk is stationary.

2. The paint roller of claim 1, wherein a frictional surface is employed at said circumferential contact region between said pinion and said drive disk to force rotation of said pinion during rotation of said drive disk.

3. The paint roller of claim 1, wherein gear teeth are employed at said circumferential contact region between said pinion and said drive disk to force rotation of said pinion during rotation of said drive disk.

4. The paint roller of claim 1, wherein said support includes a trough portion in order to function as a paint roller splatter shield.

5. The trough portion of claim 4, wherein said trough portion includes at an end a means to rotatably secure said hub member.

6. The paint roller of claim 1, wherein said support includes a wire form having a portion collinear with a paint roller axis of rotation.

7. An improved paint roller comprising:

(a) a rotatable paint applicator;

(b) a hub fixed to an axial end of said applicator;

(c) a support to rotatably secure said hub member;

(d) a pinion gear fixed on center to an axial end of said hub;

(e) a drive gear rotatably attached to said support to engage with said pinion gear;

(f) said drive gear having a circumferential portion which allows independent rotation of said pinion gear while said drive gear remains stationary.

8. The paint roller of claim 7, wherein said pinion gear and said drive gear has center line spacing between said pinion and gear fixed.

9. The paint roller of claim 7, wherein said support includes a handle to facilitate operation during painting.

10. The paint roller of claim 7, wherein said paint applicator is of cylindrical configuration.

11. The paint roller of claim 7, wherein said paint applicator is of a tapered annular configuration used to paint interior corners between walls.

12. An improved paint roller comprising:

(a) a rotatable paint applicator;

(b) a hub fixed to an axial end of said applicator;

(c) a housing member to rotatably secure said hub member;

(d) a pinion gear fixed about center of said hub;

(e) a pinion gear rotational axis about which said pinion gear rotates;

(f) a drive gear rotatably secured to said housing member;

(g) a drive gear rotational axis about which said drive gear rotates;

(h) said drive gear attached to said housing member such that drive gear is rotated while a portion of said drive gears circumference is in contact with and causes rotation of said pinion;

(i) said pinion gear and said drive gear having axis center line spacing between them fixed;

(j) said drive gear having a portion of said circumference radially reduced toward said drive gear rotational axis to allow said pinion to rotate independently while said drive gear is stationary.

13. The paint roller of claim 12, wherein said housing member includes a trough portion in order to function as a paint roller splatter shield.

14. The paint roller of claim 12, wherein said drive gear includes a handle to facilitate gear rotation.

15. The paint roller of claim 12, wherein said housing member includes a handle to facilitate operation during the painting act.

16. The paint roller of claim 12, wherein said paint applicator is of cylindrical configuration.

17. The paint roller of claim 12, wherein said paint applicator is of a tapered annular configuration used to paint interior corners between walls.

* * * * *